United States Patent [19]

Baker

[11] Patent Number: 4,962,285

[45] Date of Patent: Oct. 9, 1990

[54] ELECTRICALLY GROUNDABLE SWIMMING POOL DECK ANCHOR OF PLASTIC MATERIAL

[76] Inventor: William H. Baker, 50 Fairway Ridge, Clover, S.C. 29710

[21] Appl. No.: 267,487

[22] Filed: Nov. 4, 1988

[51] Int. Cl.[5] ..... E02D 27/42; E04H 4/06; H01R 4/66

[52] U.S. Cl. ..... 174/6; 4/504; 52/298; 439/92; 439/817

[58] Field of Search ..... 174/6, 78; 4/504; 52/298, 169.7, 165; 182/87, 93; 403/24, 361, 263, 327, 329, 397; 405/244; 439/92, 95, 96, 100, 101, 103, 108, 817, 818; 248/511, 519, 539, 357, 188.9, 156, 158, 314, 530

[56] References Cited

U.S. PATENT DOCUMENTS

| | | | |
|---|---|---|---|
| 1,631,227 | 6/1927 | See | 248/511 |
| 2,153,199 | 4/1939 | Miller | 174/78 X |
| 3,420,558 | 1/1969 | Whitten, Jr. | 52/298 X |
| 3,990,671 | 11/1976 | Seyler | 248/539 |
| 4,486,059 | 12/1984 | Deyoung | 439/92 |

FOREIGN PATENT DOCUMENTS

| | | | |
|---|---|---|---|
| 499285 | 11/1950 | Belgium | 439/818 |
| 220578 | 7/1942 | Switzerland | 439/817 |
| 562660 | 6/1977 | U.S.S.R. | 248/357 |
| 224996 | 11/1924 | United Kingdom | 439/818 |
| 779791 | 7/1957 | United Kingdom | 248/357 |

*Primary Examiner*—Laramie E. Askin

[57] ABSTRACT

An electrically groundable swimming pool deck anchor of plastic material is provided, which has a resilient member for engaging in electrical grounding contact a swimming pool component to be held in the anchor.

10 Claims, 2 Drawing Sheets

ELECTRICALLY GROUNDABLE SWIMMING POOL DECK ANCHOR OF PLASTIC MATERIAL

Swimming pools require for convenience of access and use accessories and components such as stairs and ladders, which need to be removably attached at the pool edge. For this purpose anchors normally are inset in the deck surrounding the pool. Other swimming pool components which may be held in deck anchors include diving board supports, lifeguard chairs, and starting platforms. In addition, for competition purposes, pools require lane markers, which held in stanchions anchored in the deck. Also, the swimming pool deck can be protected by a rim railing held in stanchions, precluding access to the pool except at ladders or stairs or in the shallow portions of the pool.

To protect swimmers and persons entering and leaving the water from electrical shock, most requlatory authorities require that deck anchors be grounded. This is easily done by making the deck anchor of metal, such as cast bronze or stainless steel, to aid in resisting corrocion. When, however, the deck anchor is made of a different metal from the swimming pool component anchored therein, electrolytic corrosion nonetheless can result. In any case, metal will corrode with time, although if resistant to corrosion, damage can take longer to develop.

Plastic materials are more corrision-resistant than any metal, but unfortunately are not electrically conducting. No practical method has been found to date to provide a grounding connection at a plastic deck anchor. Consequently, no available plastic anchor construction has been found that is acceptable under current electrical grounding regulations. In accordance with the present invention, an electrically groundable swimming pool deck anchor is provided of plastic material, comprising, in combination:

(1) a housing of plastic electrically insulating material;

(2) a socket in the housing having an open end, for reception of a swimming pool component to be anchored to a swimming pool deck in which the anchor is to be placed;

(3) an opening through a side wall of the housing communicating with the socket and extending to the outside of the socket;

(4) a resilient member in the opening projecting into the socket in a position to engage, in electrical grounding contact, a swimming pool component when inserted in the socket; and (5) means forming an electrical grounding connection with the resilient menber and mounted on the outside of the housing.

The invention is applicable to any plastic material, including but not limited to polyvinyl chloride, polyamides, polyesters, polytetrafluoroethylene, polycabonates, polyoxymethylene, acrylonitrile-styrene-butadiene copolymers, butadiene-styrene copolymers, polyacrylonitrile, polyvinylidene chloride, melamine-formaldehyde, phenol-formaldehyde, polypropylene, polyethylene, polysiobutylene, polyisopentylene and other synthetic rubbers.

Preferred embodiments of the invention are shown in the drawings, in which.

Figure 1:
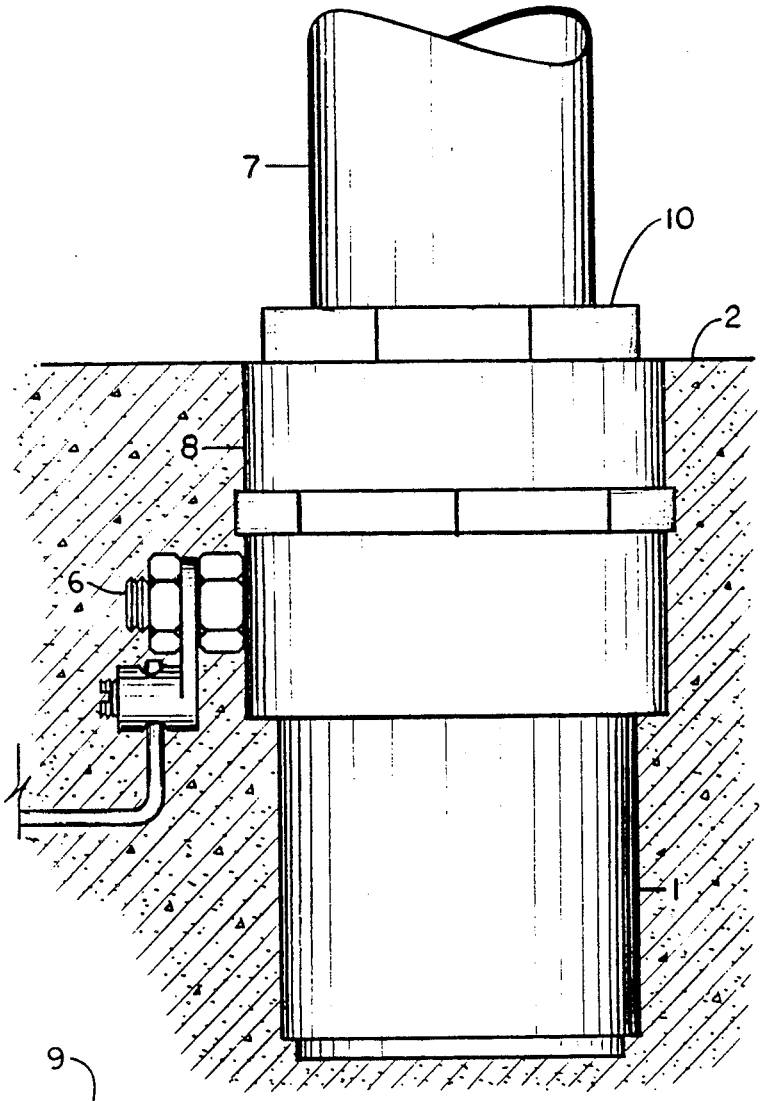
FIG. 1 represents a side view of one embodiment of electrically groundable swimming pool deck anchor in accordance with the invention.
Figure 2:
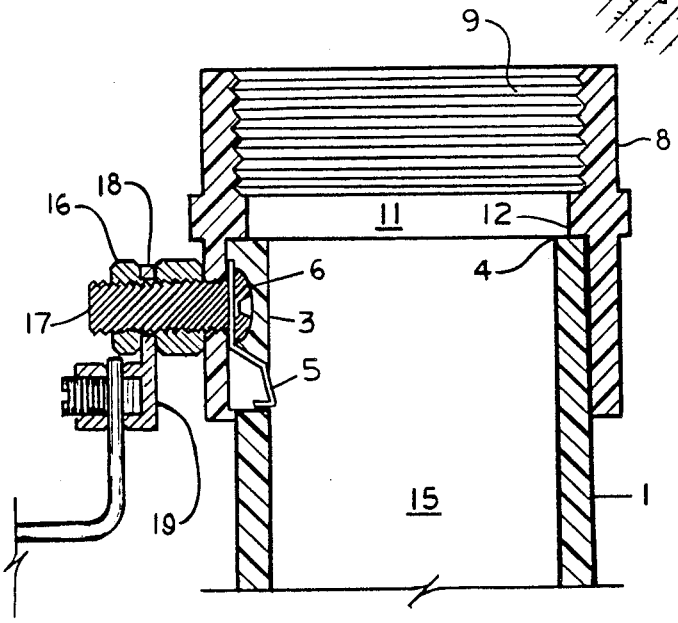
FIG. 2 represents a longitudinal section through the deck anchor of FIG. 1.
Figure 3:
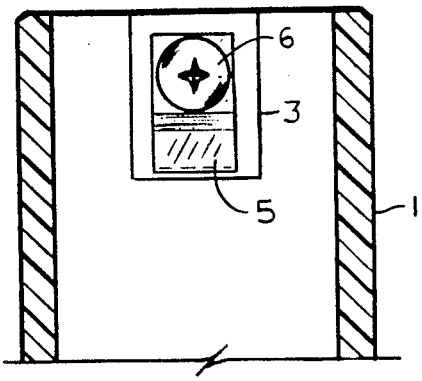
FIG. 3 represents a view of the side wall of the housing of the deck anchor of FIG. 2, viewed from inside, towards the notch on the inside face with the resilient member in place.

The deck anchor shown in FIG. 1 to 3 has a housing 1 made of electrically insulating plastic material, in this case polyvinyl chloride, but any other plastic material selected from those mentioned above as illustrative can be employed. The housing is cylindrical, and is adapted to be mounted in a socket in the deck 2 of a swimming pool, only the top of the deck being shown in FIG. 1.

As best seen in FIGS. 2 and 3, there is an aperture or notch 3 in the side wall of the housing, extending from the open end 4 of the housing, with a length sufficient to accomodate the leaf or wire spring 5 when pressed towards the mounting bolt 6 upon contact with a swimming pool component, in this case stanchion post 7. Inserted over the open end 4 of the housing is a threaded coupling 8, also of polyvinyl chloride or other plastic material. This coupling can be held in place on the housing end 4 simply by a press-fit, or by bonding to the housing with any suitable polyvinyl chloride resin contact or pressure adhesive.

The inside of the open end portion 9 of the coupling 8 is threaded, for reception and anchoring thereto of a correspondingly threaded locking bushing 10 which holds the stanchion post in position. The threaded connection holds the post tight against withdrawal or rotating movement. Instead of threads, a bayonet joint can be used. A press-fit may also be sufficient, particularly if the end of the bushing or swimming pool component is tapered. A small taper is sufficient, usually form 1° to 3° to the axis of the bushing.

The coupling has an open central passage 11, and at the inner end of the threaded portion there is a reentrant portion 12, so as to hold the coupling in a limiting position when inserted over the deck anchor housing 1. Below the reentrant portion there is mounted by way of the bolt 6 a spring clip 5 which extends resiliently into the open socket 15 of the housing at the inside end, so as to engage in electrical grounding contact the swimming pool component inserted into the socket, in this instance, the stanchion 7. This contact forces the wire spring 5 into the notch 3. The input 16 threaded on the outside end 17 of the bolt retains a washer 18 which carries an electrical grounding connector 19, thus making it possible to electrically ground the wire spring 5 to the main pool ground (not shown).

Thus, in the final assembly shown in FIG. 1, with the stanchion in place, the socketed end of the stanchion 7 is in electrical contact with the spring 5 and is thus grounded via 19 to the main pool ground.

Figure 4:
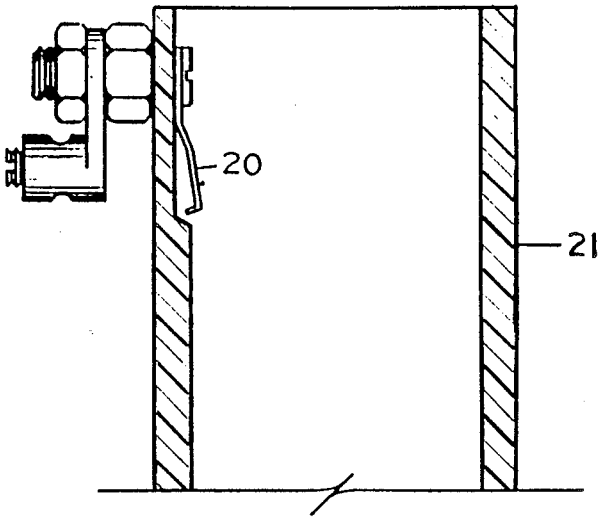
FIG. 4 is a longitudinal sectional view of another embodiment of deck anchor in accordance with the invention, in which the resilient member is directly mounted on the side wall of the housing.

FIG. 4 shows a variation of the structure shown in FIG. 1 to 3, in which the wire spring 20 is mounted directly on the housing 21, instead of to a coupling 8. Since this arrangement makes the wire spring less accessible for repair or replacement, it is less preferable than the embodiment shown in FIG. 1 to 3, but it does not have the advantage of providing an electrical grounding connection when the swimming pool component is not held to the deck way of a bushing. In the case of a ladder or stairs, for example, it is not really necessary to attach the anchoring arm of the ladder or stairs to the deck anchor, since it will stay there of its own weight, unlike the stanchion, which has to be held fixed in place, particularly when it carries lane markers or deck railings.

Figure 5:
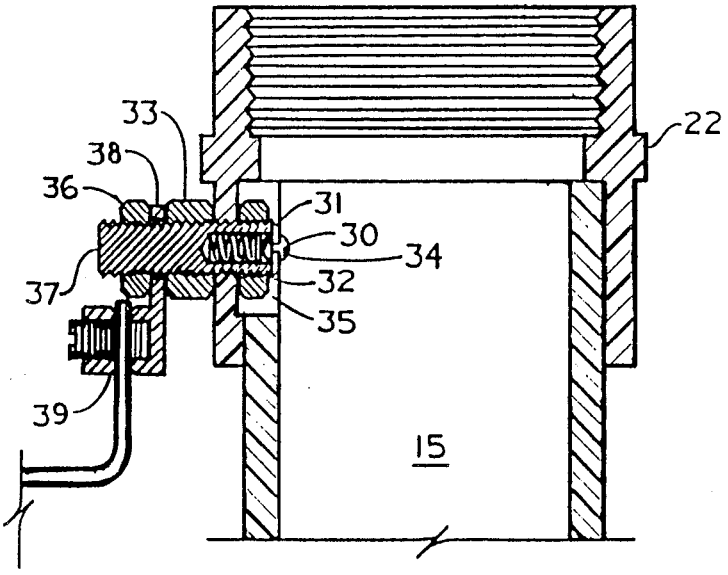
FIG. 5 is a longitudinal sectional view of another embodiment of deck anchor in accordance with the invention, in which the resilient member is in the form of a spring-mounted rotating ball poppet.
Figure 6:
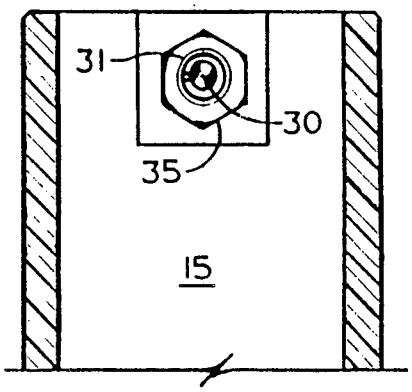
FIG. 6 represents a view of the side wall of the housing of the deck anchor of FIG. 5, viewed from the inside, towards the notch on the inside face with the ball poppet resilient member in place.

FIG. 5 and 6 show another embodiment in which the resilient member is attached to a coupling 22 similar to the coupling 8 of the embodiment of FIGS. 1–3 but is in the form of a rotatable ball 30, captured in the position shown in FIG. 5 by the cage 31, held in place by nut 35, and pressed against the swimming pool component by way of a coil compression spring 32 within the cage 31, whose other end is held in position by jam nut 33. The jam nut 33 adjusts the length of space 34 within which the ball 30 is compressed against spring 32 when the sanction 7 is inserted into the socket 15, thereby creating the compressive force exerted against the ball 30 by spring 32, so that sufficient force is continually exerted against the ball, to be sure it remains in electrical grounding contact with the swimming pool component 7 inserted in the socket 15. The cage 31 permits rotation of the ball freely in this position.

The nut 36 threaded on the outside end 37 of the cage 31 retains a washer 38 which carries an electrical grounding connector 39, thus making it possible to electrically ground the ball 30 to the main pool ground (not shown).

While the embodiments shown in the drawings employ a spring clip and a spring-mounted ball as the resilient means, any form can be employed, including, for example, leaf springs. Moreover, the ball need not be rotatable, and it can also take the form of a poppet. Other variations will be apparent to those skilled in this art.

The invention is applicable to any design of deck anchor providing a socket within a housing mounted to the deck or other side construction of a swimming pool. Since swimming pool components come in standard designs, so also do deck anchors, as they must be adapted to receive such standard designs for universal application. The particular design or configuration of the deck anchor housing consequently is entirely conventional, and forms no part of the invention, which resides in the probision of a resilient member in a side wall of the housing projecting into the socket in the housing in a position to engage a swimming pool component in electrically grounding contact.

Similarly, the invention is applicable to any type of swimming pool, including pools with concrete decks, stainless steel decks with a built-in gutter and clean water conduit system, including but not limited to those shown in U.S. Pat. Nos. 3,668,712; 3,668,713; 3,668,714; 4,050,104; 4,133,058; 4,133,059; and 4,146,937.

Having regard to the foregoing disclosure the following is claimed as the inventive and patentable embodiments thereof:

1. An electrically groundable swimming pool deck anchor of plastic material, adapted for mounting in the swimming pool deck flush with the deck surface, comprising, in combination:

(1) a housing of plastic electrically insulating material;

(2) a socket in the housing having an open end for reception of a swimming pool component to be anchored therein;

(3) a coupling means on the housing fro retaining in the socket in the swimming pool component when inserted in the open end of the socket in the housing;

(4) an opening through a side wall of the housing communicating with the socket and extending to the outside of the socket;

(5) a resilient member in the opening in a position to engage, but only in direct electrical grounding contact, a swimming pool component when inserted in the socket; and accessible from the interior of the socket; and (6) means forming an electrical grounding connection with the resilient member and mounted on the outside of the housing.

2. An electrically groundable swimming pool deck anchor in accordance with claim 1, in which the socket is tapered for reception of a swimming pool component in a press fit.

3. An electrically groundable swimming pool deck anchor in accordance with claim 1 in which the resilient member is in the form of a wire spring.

4. An electrically groundable swimming pool deck anchor in accordance with claim 1 in which the resilient member is in the form of a leaf spring.

5. An electrically groundable swimming pool deck anchor in accordance with claim 1 in which the resilient member is in the form of a coil spring.

6. An electrically groundable swimming pool deck anchor in accordance with claim 1 in which the resilient member is in the form of a coil spring and ball assembly.

7. An electrically groundable swimming pool deck anchor in accordance with claim 1 in which the coupling means is an integral part of the housing.

8. An electrically groundable swimming pool deck anchor of plastic material, comprising, in combination:

(1) a housing of plastic electrically insulateing material;

(2) a socket in the housing having an open end for reception of a swimming pool component to be anchored therein;

(3) a coupling means on the housing for retaining in the socket a swimming pool component when inserted in the open end of the socket in the housing; the coupling means being a separate couplimg member attached to the housing and mounted across the open end of the socket in the housing;

(4) an opening through a side wall of the housing communicating with the socket and extending to the outside of the socket;

(5) a resilient member in the opening in a position to engage, in electrical grounding contact, a swimming pool component when inserted in the socket; and (6) means forming an electrical grounding connection with the resilient menber and mounted on the outside of the housing.

9. An electrically groundable swimming pool deck anchor of plastic material, comprising, in combination:

(1) a housing of plastic electrically insulating material;

(2) a socket in the housing having an open for reception of a swimming pool component to be anchored therein;

(3) a coupling means on the housing for retaining in the socket a swimming pool component when inserted in the open end of the socket in the housing; the coupling means being a member to which the resilient member is attached for retaining a swimming pool component in the socket and which is removably mounted across the open end of the socket in the housing;

(4) an opening through a side wall of the housing communicating with the socket and extending to the outside of the socket;

(5) a resilient member in the opening in a position to engage, in electrical grounding contact, a swimming pool component when inserted in the socket; and (6) means forming an electrical grounding connection with the resilient member and mounted on the outside of the housing.

10. An electrically groundable swimming pool deck anchor of plastic material, comprising, in combination:

(1) a housing of plastic elecrically insulating material;

(2) a socket in the housing having a open end for reception of a swimming pool component to be anchored therein;

(3) an opening through a side wall of the housing communicating with the socket and extending to the outside of the socket;

(4) a resilient member in the opening in a position to engage, in electrical grounding contact, a swimming pool component when inserted in the socket; and (5) means forming an electrical grounding connection with the resilient member and mounted on the outside of the housing; the resilient member being attached to a coupling for retaining a swimming pool component when inserted in the socket and mounted across the open end of the socket in the housing.

* * * * *